US008662094B2

(12) United States Patent
Amladi

(10) Patent No.: US 8,662,094 B2
(45) Date of Patent: Mar. 4, 2014

(54) WALKING AID

(76) Inventor: Leela J Amladi, Los Altos, CA (US)

( * ) Notice: Subject to any disclaimer, the term of this patent is extended or adjusted under 35 U.S.C. 154(b) by 0 days.

(21) Appl. No.: 13/470,296

(22) Filed: May 12, 2012

(65) Prior Publication Data

US 2013/0298953 A1 Nov. 14, 2013

(51) Int. Cl.
*A45B 9/04* (2006.01)

(52) U.S. Cl.
USPC ..... 135/84; 135/86

(58) Field of Classification Search
USPC ..... 135/77, 82, 84, 86
See application file for complete search history.

(56) References Cited

U.S. PATENT DOCUMENTS

| | | | | |
|---|---|---|---|---|
| 3,301,268 | A * | 1/1967 | Tryon | 135/69 |
| 4,062,372 | A | 12/1977 | Slusher | |
| 5,103,850 | A * | 4/1992 | Davis | 135/84 |
| 5,301,704 | A | 4/1994 | Brown | |
| 5,331,989 | A | 7/1994 | Stephen | |
| 5,409,029 | A * | 4/1995 | Davis | 135/68 |
| 5,465,745 | A * | 11/1995 | Davis | 135/82 |
| 5,865,204 | A | 2/1999 | Bracy | |
| 6,851,437 | B1 * | 2/2005 | Lenhart | 135/72 |
| 7,188,634 | B2 | 3/2007 | Coakley | |
| 7,434,592 | B2 * | 10/2008 | Larson et al. | 135/73 |
| 7,757,537 | B1 * | 7/2010 | Hartranft | 72/458 |
| 7,882,848 | B2 | 2/2011 | Diamond | |
| 7,954,502 | B2 | 6/2011 | Townsend | |
| 7,958,902 | B2 | 6/2011 | Ruddy | |
| 2006/0185703 | A1 * | 8/2006 | Townsend et al. | 135/82 |
| 2012/0260958 | A1 * | 10/2012 | Reitano et al. | 135/83 |

OTHER PUBLICATIONS

Lifetime Tru-Motion Curved-Foot Quad Cane, http://www.buylifetime.com/Products/BLT/PID-1009.aspx.*

* cited by examiner

*Primary Examiner* — David R Dunn
*Assistant Examiner* — Danielle Jackson
(74) *Attorney, Agent, or Firm* — Soody Tronson Law Group, P.C.

(57) ABSTRACT

Embodiments of walking aids, which may comprise a handle, a shaft, and a base, are described.

15 Claims, 2 Drawing Sheets

WALKING AID

BACKGROUND

When an individual becomes injured, undergoes surgery, or experiences pain or inflammation in the joints of the knee or the foot, the individual may make use of a cane or other type of mobility aid. The use of a mobility aid can allow the individual to remain active and thus maintain his or her independence. However, in many instances, despite an individual's best attempts to adjust their lifestyle to accommodate the need for the mobility aid, many individuals find using mobility aids cumbersome and awkward.

In some instances, a mobility aid may feel comfortable when used, for example, as an aid to assist an individual in walking over a short distance. However, when used for walking over longer distances, the individual using the walking aid may experience soreness in the hand manipulating the walking aid, a sore shoulder, or may experience other discomfort brought about by the use of a walking aid that is not quite suitable for the user's activity envelope.

SUMMARY

In an embodiment, a walking aid comprises a handle coupled to a first portion of a shaft. A walking aid may also comprise a base that is of a width similar to a width of the shaft and coupled to a second portion of the shaft. A base may comprise a first and a second edge separated by an angle greater than 90 degrees, a lower peripheral arc forming a distal edge of the base, wherein a distal edge maybe removably attached to a slip-resistant surface. A walking aid may further comprise a removably attached pliant material between a slip-resistant surface and a distal edge.

In an embodiment, a base that couples to a shaft of a walking aid, for example, may comprise first and second edges separated by an angle greater than 90 degrees. The base also comprises a slip-resistant surface capable of being removably fastened to a pliant material, wherein the pliant material is capable of being removably fastened to a distal edge of the base. A slip-resistant surface may extend from at least a distal portion of the first edge to at least a distal portion of the second edge. A base may be of a width similar to a width of the shaft.

In an embodiment, a walking aid may comprise a handle coupled to a first end portion of a shaft and a base coupled to a second end portion of the shaft, wherein a base is of a width similar a width of the shaft. A base may comprise a distal edge that subtends an obtuse angle. The walking aid may further comprise means for adjusting the length of the shaft, wherein such adjusting may comprise extending and/or retracting the length of the shaft.

BRIEF DESCRIPTION OF THE DRAWINGS

The accompanying drawings, which are incorporated in and constitute a part of the specification, illustrate various apparatuses and embodiments of the disclosure. It will be appreciated that the illustrated element boundaries (e.g., boxes, groups of boxes, or other shapes) in the figures represent one example of the boundaries. In some examples, one element may be designed as multiple elements or that multiple elements may be designed as one element. In some examples, an element shown as an internal component of another element may be implemented as an external component and vice versa. Furthermore, elements may not be drawn to scale.

DETAILED DESCRIPTION

Described herein are example apparatuses and mechanisms used in association with walking aids. Embodiments of the invention provide individuals with a walking aid that provides comfortable walking over a variety of flat or uneven surfaces. The walking aid may be removably secured to an individual's hand or wrist using a closed loop fastener of an adjustable length, thus precluding the user from dropping the walking aid during its use. The walking aid may be adjusted in length (e.g. extended or retracted) to accommodate a user's particular height. The walking aid may also comprise a removably attached pliant, slip-resistant surface, which may ensure the user's safe passage over a variety of flat or uneven concrete, asphalt, or indoor surfaces.

In an embodiment, the base of the walking aid is of a width that is comparable or similar to that of a shaft of the walking aid, thus allowing the user to manipulate the walking aid on crowded sidewalks or on uneven surfaces, which may comprise patchy, rough, rocky, or jagged terrain, for example. In an embodiment, the slip-resistant surface as well as the pliant material may comprise a hook and loop fastener system (such as, for example, Velcro™) to bring about the simple removal and replacement of the pliant material and/or the slip-resistant surface. In other embodiments, one or more snaps or any other fastener or fastener system may be used.

Figure 1:
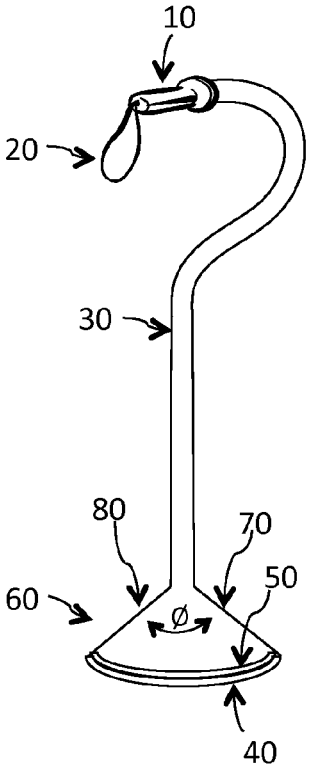
FIG. 1 illustrates an embodiment of a walking aid.

With reference to FIG. 1, an embodiment of a walking aid is illustrated. In an embodiment, handle 10 is secured to first end portion of shaft 30 in a manner that precludes detachment of handle 10 from shaft 30. In an embodiment, handle 10 is removably fastened to shaft 30, which permits detachment of handle 10 from shaft 30. Although shaft 30 is shown as having a particular curvature in FIG. 1, nothing prevents the use of other shapes, such as a shaft that comprises an approximate right angle as opposed to the circularly curved shaft shown. In other embodiments, shaft 30 may comprise various other shapes and angles to accommodate particular situations, and claimed subject matter is not limited in this regard.

Wedge-shaped base 60 is shown as being removably attached to a second end portion of shaft 30. Base 60 may comprise a first edge 70 and second edge 80, which may be separated by an angle greater than 90 degrees. In FIG. 1, first edge 70 and second edge 80 are shown as being separated by an angle 0, which may approximate an angle of 120 degrees. However, it should be noted that embodiments of the invention are not so limited. For example, in some embodiments, base 60 may comprise first and second edges (70 and 80) separated by obtuse angles of 130 degrees, 140 degrees, or other example angles. In other embodiments, base 60 may comprise first and second edges separated by 110 degrees, 100 degrees, or other example angles.

FIG. 1 shows a lower peripheral arc forming a distal edge of base 60. At a distal edge of base 60, a pliant material 50 is shown intervening between the distal edge and slip-resistant surface 40. In an implementation, the distal edge of base 60 may accommodate a hook and loop fastener system that removably adheres pliant material 50 to the distal edge. In an implementation, a second hook and loop fastener system may be used to removably attach pliant material 50 to slip-resistant surface 40.

Figure 2:
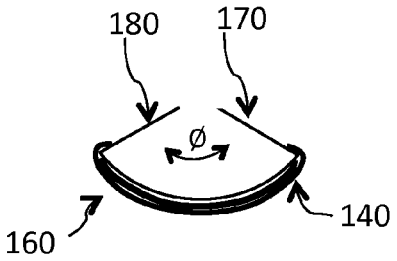
FIG. 2 illustrates an embodiment of a base, which may be used in association with a walking aid.

FIG. 2 illustrates an embodiment of a base, which may be used in association with a walking aid. In FIG. 2, slip-resistant surface 140 is shown as not only encompassing the distal edge of base 160, but also extending upwards along a portion of one or more of first edge 170 and second edge 180.

Figure 3:
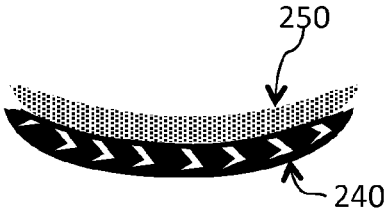
FIG. 3 illustrates an embodiment of a slip-resistant surface and pliant material used in association with a walking aid.

FIG. 3 illustrates an embodiment of a slip-resistant surface and pliant material used in association with a walking aid. In FIG. 3, slip-resistant surface 240 may comprise a rubberized material having grooves or other traction-enhancing features. Further, slip-resistant material 240 may comprise a hook and loop fastener system to removably attach to pliant material 250. Pliant material 250 may comprise urethane foam, neoprene or other elastic material that provides a cushion between slip-resistant material 240 and the distal edge of the base of the walking aid. In an embodiment, a pliant material 250 may comprise a hook and loop fastener system to removably attach to a distal edge of base member of a walking aid, such as a distal edge of base 160 of FIG. 2.

Figure 4:
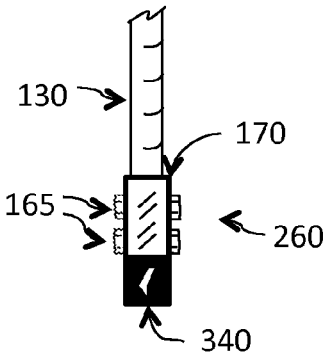
FIG. 4 illustrates a side view of a shaft and base used in an embodiment of a walking aid.

FIG. 4 illustrates a side view of a portion of a shaft and a base used in an embodiment of a walking aid. In FIG. 4, shaft 130 is shown as removably attaching to base 260 by way of hexagonal bolts 165. Although two hexagonal bolts 165 are shown in FIG. 4, nothing prevents the use of a lesser number or a greater number of hexagonal bolts as well as other types of fasteners such as rivets, spot welds, sheet metal screws, and so forth. First edge 170 is shown in FIG. 4, as is slip-resistant surface 340. As can be seen in FIG. 4, base 260 is of a width comparable or similar to the width of shaft 130.

Figure 5:
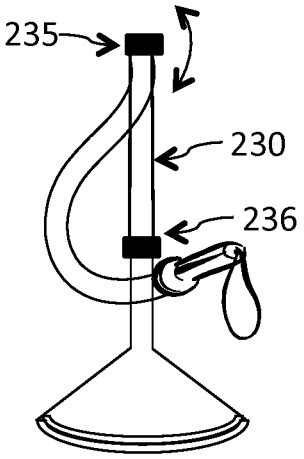
FIG. 5 illustrates an embodiment of a foldable walking aid.

FIG. 5 illustrates another embodiment of a walking aid. In FIG. 5, hinge 235, which may be positioned at an approximate midpoint of shaft 230, is shown as drawing together a first end portion and a second end portion of the shaft. Additionally shown in FIG. 5 is adjustment knob 236, which may be used to adjust, such as retracting and/or extending, the length of shaft 230 to accommodate the unique height of a particular individual using the walking aid. Adjustment knob 236 may operate by way of a threaded grip that clamps a wider portion of shaft 230 around a thinner portion of the shaft, as shown in FIG. 5.

Figure 6:
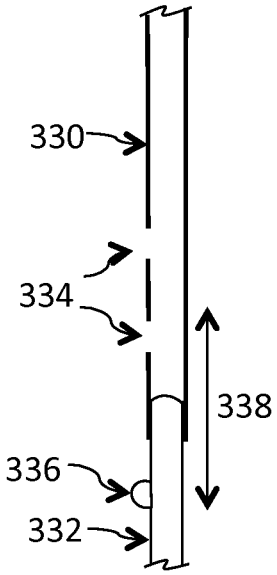
FIG. 6 illustrates a mechanism for adjusting a length of a shaft used in an embodiment of a walking aid.

FIG. 6 illustrates a second mechanism for adjusting the length of a shaft used in an embodiment of a walking aid. FIG. 6, a shaft comprises wider section 330 and thinner section 332. Button 336, which may be spring-loaded, may be depressed so that thinner section 332 may positioned within wider section 330, as shown by arrow 338. When the button 336 emerges from one of holes 334, the length of the shaft may be locked.

With the present apparatuses, walking aids usable by a wide variety of individuals are described. In an embodiment, a walking aid comprises an adjustable shaft length, a curved base, a slip-resistant surface, and a pliant material that provides comfort to its user when navigating over flat or uneven surfaces. In addition to a closed loop fastener system to removably secure the walking aid to an object, the walking aid may be folded to reduce the volume consumed by the walking aid when not in use.

The following includes definitions of selected terms employed herein. The definitions include various examples and/or forms of components that fall within the scope of a term and that may be used for implementation. The examples are not intended to be limiting. Both singular and plural forms of terms may be within the definitions.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

To the extent that the term "includes" or "including" is employed in the detailed description or the claims, it is intended to be inclusive in a manner similar to the term "comprising" as that term is interpreted when employed as a transitional word in a claim. Use of the terms "coupled" and "connected" and the like herein, along with their derivatives, may be used. It should be understood that these terms are not intended as synonyms for each other. Rather, in particular embodiments, "connected" may be used to indicate that two or more elements are in direct physical contact with each other. "Coupled" may be used to indicate that two or more elements are in either direct or indirect (with other intervening elements between them) physical contact with each other, or that the two or more elements cooperate or interact with each other (e.g. as in a cause an effect relationship).

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the disclosure is not limited to the specific details, the representative apparatus, and illustrative examples shown and described. Thus, this application is intended to embrace alterations, modifications, and variations that fall within the scope of the appended claims.

What is claimed is:

1. A walking aid, comprising:

a handle coupled to a first portion of a shaft; and a base, having a width similar to a width of the shaft, coupled to a second portion of the shaft, the base including:

first and second edges separated by an angle greater than 90 degrees;

a lower peripheral arc forming a distal edge of the base, the distal edge coupled to a slip-resistant surface; and a pliant material between the slip-resistant surface and the distal edge, the slip-resistant surface being removably fastened to the pliant material by way of a hook and loop fastening system.

2. The walking aid of claim 1, wherein the shaft further comprises:

at least one hinge that, at least in part, draws together a first end portion and a second end portion of the shaft.

3. The walking aid of claim 2, wherein the at least one hinge is disposed at an approximate midpoint between the first end portion and the second end portion of the shaft.

4. The walking aid of claim 1, further comprising an adjustment knob that, at least in part, changes the length of the shaft.

5. The walking aid of claim 1, wherein the shaft further comprises:

at least one adjusting button disposed at the first portion of the shaft, and at least two holes disposed on the second portion of the shaft.

6. The walking aid of claim 1, additionally comprising:

a closed loop fastener of an adjustable length affixed to the handle that removably secures the walking aid to an object.

7. The walking aid of claim 1, wherein the first and second edges are separated by an angle of approximately 120 degrees.

8. The walking aid of claim 1, wherein the slip-resistant surface comprises a rubberized material.

9. The walking aid of claim 1, wherein the pliant material comprises a urethane foam or neoprene.

10. The walking aid of claim 1, wherein the pliant material is removably fastened to the distal edge by way of the hook and loop fastening system.

11. A base that couples to a shaft of a walking aid, comprising:

first and second edges separated by an angle greater than 90 degrees; and a slip-resistant surface capable of being removably fastened by way of a hook and loop fastening system to a pliant material, the pliant material capable of being removably fastened to a distal edge of the base, wherein the slip-resistant surface extends from at least a distal portion of the first edge to at least a distal portion of the second edge, and wherein the base is of a width similar to a width of the shaft.

12. The base of claim 11, wherein the slip-resistant surface additionally extends along a portion of one or more of the first and second edges of the base.

13. The base of claim 11, wherein the pliant material comprises elastic foam.

14. The base of claim 11, wherein the distal edge forms an arc between the first and the second edges.

15. A walking aid, comprising:

a handle coupled to a first end portion of a shaft;

a base coupled to a second portion of the shaft, the base having a width similar to a width of the shaft, the base having a distal edge that subtends an obtuse angle;

means for removably fastening a pliant material to the distal edge;

means for extending the length of the shaft; and a hook and loop fastening system for removably fastening a slip-resistant material to the pliant material.

* * * * *